US005227224A

United States Patent [19]

Ishikawa et al.

[11] Patent Number: 5,227,224

[45] Date of Patent: Jul. 13, 1993

[54] STRETCHABLE NONWOVEN FABRICS AND METHOD FOR PRODUCING SAME

[75] Inventors: Hirotoshi Ishikawa, Ikoma; Seiji Yokota, Moriyama, both of Japan

[73] Assignee: Chisso Corporation, Osaka, Japan

[21] Appl. No.: 420,315

[22] Filed: Oct. 12, 1989

[30] Foreign Application Priority Data

Oct. 28, 1988 [JP] Japan ..... 63-272545

[51] Int. Cl.[5] ..... D04H 1/46; D04H 1/48; D04H 1/50

[52] U.S. Cl. ..... 428/212; 26/18.5; 28/104; 428/296; 428/360; 428/370; 156/84

[58] Field of Search ..... 26/18.5; 28/104; 428/212, 296, 360, 370; 156/84

[56] References Cited

U.S. PATENT DOCUMENTS

| | | | |
|---|---|---|---|
| 4,172,172 | 10/1979 | Suzuki et al. | 428/224 |
| 4,211,819 | 7/1980 | Kunimune et al. | 428/374 |
| 4,426,420 | 1/1984 | Likhyani | 428/224 |
| 4,551,378 | 11/1985 | Carey | 428/198 |
| 4,789,592 | 12/1988 | Taniguchi | 428/374 |

FOREIGN PATENT DOCUMENTS

| | | |
|---|---|---|
| 0168225 | 1/1986 | European Pat. Off. . |
| 15141 | 5/1976 | Japan . |
| 157362 | 9/1984 | Japan . |
| 177269 | 8/1987 | Japan . |

OTHER PUBLICATIONS

Abstract of Japanese Patent No. 76/15141.

*Primary Examiner*—James C. Cannon

*Attorney, Agent, or Firm*—Oblon, Spivak, McClelland, Maier & Neustadt

[57] ABSTRACT

A stretchable nonwoven fabric is provided, in which a uniform web comprising 70 to 100% by weight of polypropylene base heat-bondable composite fibers and 0 to 30% by weight of other organic fibers and having a web heat shrinking percentage "A" of 50% or lower at 100° C. and a web heat shrinking percentage "B" of 50% or higher at 120° C. provided that a difference "B"-"A" between the latter and the former is 20% or higher, the fibers being uniformly entangled together, has been shrinked as a result of sufficient crimping and more increased entanglement of the above composite fibers imparted through further heat-treatment, and which has an elastic recovery-at-30%-elongation of 80% or higher in both the warp and weft directions. This nonwoven fabric has no density variation, no crease, and excellent stretchability.

4 Claims, 2 Drawing Sheets

STRETCHABLE NONWOVEN FABRICS AND METHOD FOR PRODUCING SAME

BACKGROUND OF THE INVENTION

The present invention relates to a nonwoven fabric flexible and excellent in stretchability and so suitable for use in such applications as supporters, bandages and backing materials for poultice or cataplasm. The present invention also relates to a method for producing the nonwoven fabric.

PRIOR ART

Heretofore, there have been available various method for producing stretchable nonwoven fabrics, typically, a method in which thermoplastic polyurethane fibers are used as a raw material (see Japanese Patent Laid-Open Publication No. 59-157362), a method in which highly crimpable polyester fibers are heat-bonded together with hot-melt type of binder fibers (refer to Japanese Patent Laid-Open Publication No. 62-177269) and other like methods.

However, problems with nonwoven fabrics using polyurethane fibers are that they have a large specific weight and show rubber-like tacky hand, while the use of polyester fibers gives rise to a disadvantage of being too hard in handling.

SUMMARY OF THE INVENTION

An object of the present invention is to provide a nonwoven fabric which is flexible, free from tackiness and excellent in stretchability and a method for producing the nonwoven fabric.

According to one aspect of the present invention, there is provided a stretchable nonwoven fabric in which a uniform web comprising 70 to 100% by weight of polypropylene base heat-bondable composite fibers and 0 to 30% by weight of other organic fibers and having a web heat shrinking percentage "A" of 50% or lower at 100° C. and a web heat shrinking percentage "B" of 50% or higher at 120° C. provided that a difference "B"-"A" between the latter and the former is 20% or higher, said fibers being uniformly entangled together, has been shrinked as a result of sufficient crimping and more increased entanglement of the above composite fibers imparted through further heat-treatment, and which has an elastic recovery-at-30%-elongation of 80% or higher in both the warp and weft directions. According to this first aspect, crimping and entanglement of the heat-bondable composite fibers may be not only in very high degree but also very uniform. Then, the nonwoven fabric has no density variation, no creasing, and excellent stretchability.

According to another aspect of the present invention, there is provided a method for producing stretchable nonwoven fabric, which comprises:

subjecting to a water needle technique a uniform web comprising 70 to 100% by weight of polypropylene base heat-bondable and heat-crimpable (abbr. to heat-bondable hereafter) composite fibers and 0 to 30% by weight of other organic fibers and having a web heat shrinking percentage "A" of 50% or lower at 100° C. and a web heat shrinking percentage "B" of 50% or higher at 120° C. with the proviso that a difference "B"-"A" between the latter and the former is 20% or higher, to uniformly entangle together said fibers, and delivering the thus obtained web, in which the hydrous fibers have been entangled together, with no tension applied thereon, while hot air is alternately and successively blown to the front and back sides thereof, a temperature of which hot air is both equal to or higher than 120° C. and lower than the melting point of a high-melting component of said heat-bondable composite fibers, thereby further heat-treating said composite fibers to impart sufficient crimping and more increased entanglement thereto for the purpose of shrinking said web. According to this second aspect, crimps and entanglement are gently imparted to the composite fibers while the temperature of the fibers is not exceed 100° C. under the hydrous state, and next the crimps and entanglement are further highly imparted at successively elevated temperature after the moisture of the fibers is evaporated. Thus obtained nonwoven fabric is same one as above mentioned about the first aspect of the present invention.

DETAILED EXPLANATION OF THE INVENTION

The polypropylene base heat-bondable composite fiber to be used as the main constitutional fiber of the nonwoven fabric in the present invention is a crimpable fiber obtained by composite spinning of a side-by-side arrangement of two types of polypropylene base polymers having different melting points or a eccentrical sheath-core arrangement in which the low-melting polymer is used as a sheath component and the high-melting polymer as a core component. The nonwoven fabric according to the present invention is obtained by processing a web consisting of said composite fiber alone or containing at least 70% by weight of said composite fiber in a specific manner to be described later. To this end, the web is required to have a web heat shrinking percentage "A" of 50% or lower, preferably 15% or lower, by 5-minute heating at 100° C. and a web heat shrinking percentage "B" of 50% or higher by 5-minute heating at 120° C. with a difference between "B" of the latter shrinkage and "A" of the former shrinkage, i.e., defined by "B"-"A", being 20% or higher. A web having such heat shrinkages may be obtained by using a heat-bondable composite fiber having such components and composition as mentioned below. This is, the high-melting component used is a crystalline polypropylene (homopolymer) having a melt flow rate, or MFR for short, of 2 to 70, as measured by the method of ASTM D-1238 condition L, preferably a propylene homopolymer which is below 5.5 in terms of a Q value that is an index to its molecular weight distribution (Q=weight-average molecular weight/number-average molecular weight), while the low-melting component used is a binary or ternary copolymer composed mainly of 70% by weight or higher of propylene and containing as a compolymerizable component other α-olefins such as ethylene and butene-1, preferably a copolymer having a melting point lower than that of said high-melting component by 15° C. or lower. Then, the above heat-bondable composite fiber may be prepared and obtained through tne selection and combination of both the components and the selection of spinning and stretching conditions accommodative to such combination. It is desired to impart mechanical crimps to the heat-bondable composite fiber so as to facilitate the production of the web to be described later. Polypropylene having a Q value less than 5.5 may be obtained by the polymerization of propylene under specially selected conditions. More conveniently, it may be prepared by the following methods starting from commercially available polypropylene having a Q value of 5.5 or more. That is, according to one or the first method, 0.01 to 1.0% by weight of an organoperoxide capable of generating radicals by heating at a temperature higher than the melting point of the starting polymer such as, for instance, t-butyl hydroperoxide, cumene hydroperoxide, 2,5-dimethylhexane-2,5-dihydroperoxide or di-t-butyl diperoxide is added to and mixed with the starting polymer and then hot-extruded through an extruder for granulation. According to another or the second method, the starting polymer is extruded at elevated temperatures without adding of said organoperoxide for granulation, and this process is repeated several times for drop of the Q value.

The thus obtained heat-bondable composite fiber is formed into a web alone or in the form of an admixture with other organic fibers. It is here noted that the term "other organic fibers" refers to an organic fiber which undergoes no change of properties by such a heat treatment as will be described later, for instance, cotton, flax or hemp, rayon, polyamide or polyester, and is used with a view to regulating the handling, water absorbability and the like of the product. It is unpreferred to contain such other organic fibers in the web in an amount exceeding 30% by weight, for the reasons that the shrinkage of the web drops to such a degree that the stretchability of the nonwoven fabric becomes insufficient or that the points of entanglement or bonding with the heat-bondable composite fiber become too little to decrease the tenacity of the nonwoven fabric, and for other reasons.

A web having a heat shrinking percentage "A" at 100° C. exceeding 50% is unpreferred because, in the first half of the heat-treating step to be described later, the web shrinks so much at one time that the nonwoven fabric is uneven in density or has creases, resulting in quality deteriorations. If the heat shrinking percentage "B" at 120° C. of the web is below 50%, the entanglement among the fibers caused mainly by the development of crimps through the heat treatment then becomes insufficient, leading to a drop in the elastic recovery of the nonwoven fabric. In addition, when the web heat shrinking percentage "B" at 120° C. does not exceed "A" at 100° C. by 20%, although "B" is equal to or more than 50%, the elastic recovery of the nonwoven fabric still remains low, thus making it not possible to obtain the desired stretchable unwoven fabric. The web may be prepared by making use of the known techniques using carding machines or air-stream type of random webber, and may optionally be modified to a cross lapped web with a cross lapper.

Next, water under high pressure is jetted through a number of nozzles to the above web to entangle the fibers together. This may be achieved by known so-called "hydraulic entangling processes" such as those disclosed in Japanese Patent Laid-Open Publication Nos. 62-223355 and 59-26561.

The web, in which the fibers have been entangled together by the above hydraulic entangling treatment and which will hereinafter be referred to as the entangled web, is then delivered to the subsequent heat treating step, while remaining hydrous. Through the heat treating step, the entangled web is successively carried with no tension applied thereon, while it is heated by alternate blowing of hot air to its front and back sides.

BRIEF DESCRIPTION OF THE DRAWINGS

The heat treatment will now be explained specifically with reference to the accompanying drawings, in which.

Figure 1:
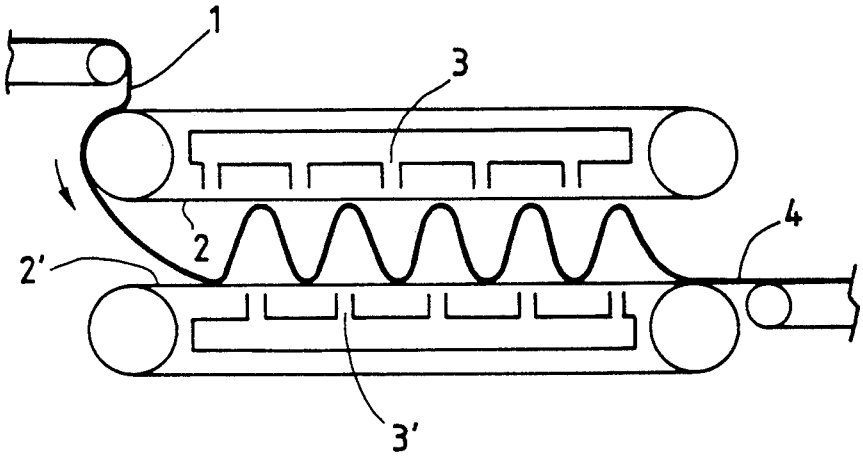
FIG. 1 is a schematical view showing the heat-treating apparatus.
Figure 2:
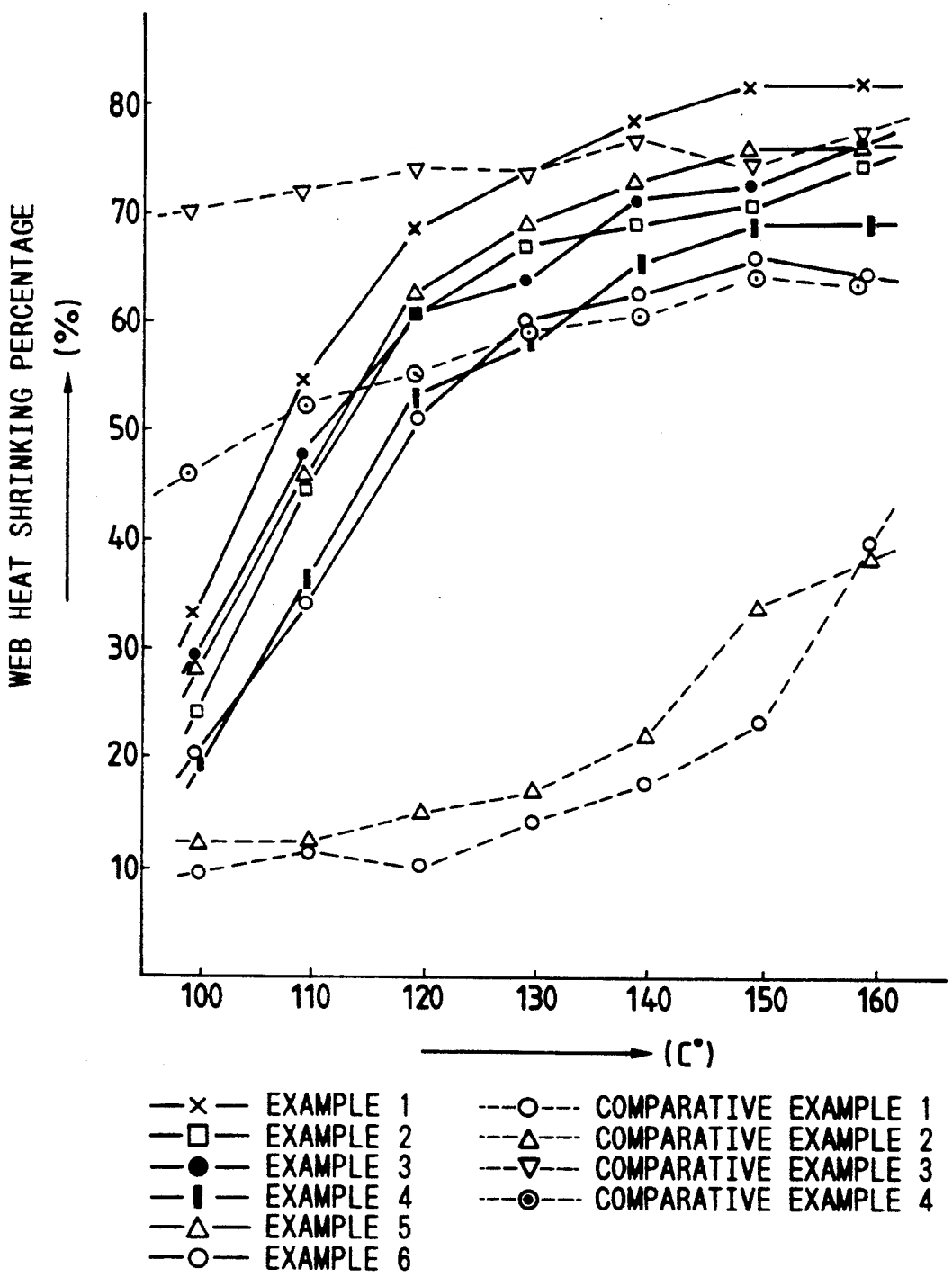
FIG. 2 is a graphical view showing the heat shrinkages at the predetermined temperatures of the webs according to the examples and comparative examples.

A web path is defined between a pair of opposite guide nets 2 and 2' operable with a certain gap maintained therebetween, the amount of said gap being 2 to 200 times, preferably 5 to 20 times larger than that of thickness of an entangled web 1. The hydrous entangled web 1 is then supplied to the web path at a suitable speed higher than the surface speed of the guide nets 2 and 2' in a direction shown by an arrow, while hot air is blown thereto through a plurality of hot air nozzles 3 and 3' which are arranged in elongate slit form transversely of the web and open toward the web path. Since the hot air nozzles 3 and 3' are disposed on both sides of the web path in zigzag fashion, the hot air is alternately and successively blown to the front and back sides of the web 1 being carried on the web path. The entangled web 1 is fed in at a speed in excess of the guide nets speed, and it is as a whole carried in contact with and at the same speed as the guide nets 2 and 2', and it receives a hot air pressure when passing in front of the respective nozzles 3 and 3'. As a result, the entangled web 1 moves in a zigzag or meanders manner as shown in FIG. 1. While carried in this manner, the entangled web 1 is subjected to drying and heating by hot air. The temperature of such hot air is 120° C. or higher but below the melting point of the high-melting component of the heat-bondable composite fibers in the web 1. Thus, while the web 1 remains hydrous in the first half of the heat-treating step, its temperature does not exceed 100° C., so that it is dried at a gentle shrinking rate corresponding to the shrinking percentage "A" at 100° C. In the second half of the heat-treating step after the web 1 has been rid of water by evaporation, the web 1 is subsequently heat-treated at a higher temperature to impart increased crimps to the composite fibers and entangle them together more tightly, whereby it is sufficiently shrunk at a shrinking rate equal to or higher than the shrinking percentage "B" at 120° C., as illustrated in FIG. 2, into a nonwoven fabric. The nonwoven fabric 4 according to the present invention is obtained by such incremental heat treatments. In this case, if the temperature of hot air is below the melting point of the low-melting component of the heat-bondable composite fibers, a nonwoven fabric 4 of increased elastic recovery is then obtained only through the entanglement among the fibers by the water needle technique and heat crimping. If the temperature of hot air exceeds the melting point of the low-melting component of the heat-bondable composite fibers, a nonwoven fabric 4 of by far increased tenacity and elastic recovery is then obtained through not only the entanglement among the fibers but also the points of contact of the fibers with one another, which are heat-bonded into a substantially fixed entanglement structure.

EFFECT OF THE INVENTION

The nonwoven fabric according to the present invention is obtained by processing a specific web containing as main constitutional fibers heat-bondable composite fibers capable of being heat-crimped into a nonwoven fabric in a specific manner. That is, a web having a heat shrinking percentage "A" of 50% or lower by 5-minute heating at 100° C. is used as that web, and is then processed into a hydrous entangled web, which is in turn heat-treated while carried without tension applied thereon. For that reason, crimps are gently imparted to the fibers in the first half of the heat treatment, since the temperature of the web does not exceed 100° C. It is thus possible to prevent density variations and creasing of the nonwoven fabric, since much shrinkage at one time otherwise tending to occur in the web can be avoided. The web to be used in the present invention also has a heat shrinking percentage "B" of 50% or higher by 5-minute heating at 120° C. and higher than "A" by 20% or higher. For that reason, the web is carried subsequent to the first half of the heat treamtent without tension applied thereon, while it is heat-treated at a temperature of 120° C. or higher in the second half of the heat treatment. In the thus obtained nonwoven fabric, the heat-bondable composite fibers that are the main constitutional fibers are sufficiently crimped, entangled tightly together or entangled and fused together at their points of contact. In this manner, there is obtained a nonwoven fabric of such increased stretchability as expressed in terms of an elastic recovery of as much as 80% at 30% elongation in both the warp and weft directions. Such nonwoven fabric is useful at a low weight per area of 15 to 300 g/m$^2$ as bandages, surfaces materials of paper diapers, clothing core materials, etc. and at a high weight per area of 300 to 1000 g/m$^2$ as stuffing for chairs or beds and packing material for packaging.

EXAMPLES

The present invention will now be explained in more detail with reference to the examples and comparative examples, wherein the physical properties were measured by the following methods.

Heat Shrinking Percentage of Web

A square sample of 25 cm×25 cm was cut out of a random web having a weight per area of 100 g/m$^2$ prepared with a carding machine, and is then interleaved between kraft paper sheets (25 cm×25 cm), which are in turn allowed to stand in a dryer at the predertermined temperatures (100° C., 120° C. and 150° C.) for five minutes and cooled down at room temperature for 30 minutes to measure its area (S cm$^2$). The heat shrinking percentage of the web is found by the following equation:

$$\text{Heat Shrinking Percentage of Web } (\%) = 100 \times (625 - S)/625$$

The result is expressed in terms of the average of five samples.

Elastic Recovery of Web

A sample piece of 15 cm in length and 2.5 cm in width is cut out of an nonwoven fabric in its warp or weft direction. With a constant-strain-rate recording tensile tester, the sample is elongated by 30 mm at a grip space of 10 cm and a tensile rate of 10 cm/min and, after the lapse of 1 minute in that state, is then relaxed at a rate of 10 cm/min. When the stress is reduced to zero during the process of relaxation, the residual elongation (A mm) is read off the recording sheet. The elastic recovery of the web is found by:

$$\text{Elastic Recovery } (\%) = (30 - A)/30 \times 100.$$

The result is estimated in terms of the average of five samples.

Uniformity of Nonwoven Fabric

Four square sample pieces, each of 25 cm×25 cm, are observed in terms of the smoothness of their both front and back sides and in terms of a density variation by seeing-through. Evaluation is made on the basis of:

Fairly Good: The four samples are all free from both surface creases and density variations.

Good: Of the four samples, one creases or varies in density on its surface.

Bad: Of the four samples, two or more crease or vary in density on their surfaces.

EXAMPLES 1 TO 6 AND COMPARATIVE EXAMPLES 1 TO 4

Various combinations of high-melting polypropylene with low-melting propylene base copolymer or polyethylene, as specified in Table 1, were subjected to composite spinning under the following identical conditions.

A spinneret with 120 holes, each of 0.6 mm is aperture, was operated at a composite ratio of 1:1 and at spinning temperatures of 280° C. on the high-melting component side and 280° C. on the low-melting component side. The obtained yarn, now unstreched, is stretched 3.5 times between the first-stage Seven-Roll of 70° C., consisting of seven rolls, and the second-stage Seven-Roll of 30° C. to form a stretched yarn having a single yarn fineness of 2.4 d/f, which was then bundled into a tow having a total deniers of 11,000. Afterwards, 18 crimps/25 mm were imparted to the tow with a stuffing box type of crimper, which was then cut to a fiber length of 65 mm, thereby obtaining a staple fiber.

Through a carding machine, the above staple fibers alone were processed into a random web having a weight per area of 22 g/m$^2$ in Examples 1 to 4 and Comparative Examples 1 to 3. In Examples 5 and 6, the above staple fibers were mixed with 10% by weight (Ex. 5) and 30% by weight (Ex. 6) of polyester fibers [2 d/f(deniers per filament)×51 mm and 12 crimps/25 mm] to obtain random webs having a weight per area of 22 g/m$^2$ through a carding machine. In Comparative Example 4, the above staple fibers were mixed with 10% by weight of rayon (2 d/f×51 mm and 15 crimps/25 mm) to obtain a random web of the same weight per area again through a carding machine.

Next, these webs were supplied to hydraulic entangling equipment through which water under a high pressure of 30 kg/cm$^2$ was jetted thereto from a multiplicity of nozzles of 0.15 mm in aperture, arranged at a pitch of 1.0 mm, while the fibers were hydraulically entangled together at a delivery speed of 30 m/min, thereby obtaining entangled webs having a water content (a weight ratio of water to fibers) of about 120%. Subsequently, the thus entangled webs were separately heat-treated through such heat-treating equipment as shown in FIG. 1 (with a belt-to-belt space of 18 mm, a length of 4.5 m and 38 hot-air blowing nozzles) under two conditions, one defined by a hot air temperature of 130° C. and a residence time of 2 minutes 20 seconds and the other by a hot air temperature of 150° C. and a residence time of 1 minute 50 seconds to obtain two nonwoven fabrics per each example and comparative example.

Summarized in Table 2 are the properties of the heat-bondable composite fibers used in the examples and comparative examples, the webs and the obtained nonwoven fabrics. Also shown in FIG. 2 are the heat shrinking percentage of the webs in the examples and comparative examples, as measured in a temperature range wider than specified in Table 2.

TABLE 1

| Symbols | Polyolefins | Physical Properties |
|---|---|---|
| P-1 | Propylene homopolymer | MFR = 8.5 MP = 164° C. Q = 3.6 |
| P-2 | Propylene homopolymer | MFR = 8.5 MP = 164° C. Q = 5.0 |

TABLE 1-continued

| Symbols | Polyolefins | Physical Properties |
|---|---|---|
| P-3 | Propylene homopolymer | MFR = 20 MP = 164° C. Q = 6.8 |
| P-4 | Random copolymer of ethylene-propylene | MFR = 8 MP = 145° C. $C_3^=$ = 97.5 wt % $C_2^=$ = 2.5 wt % |
| P-5 | Random copolymer of ethylene-propylene-butene-1 | MFR = 11 MP = 140° C. $C_3^=$ = 92 wt % $C_2^=$ = 3.5 wt % $C_4^=$ = 4.5 wt % |
| P-6 | High density polyethylene | *MI = 22 MP = 132° C. |
| P-7 | Low density polyethylene | *MI = 25 MP = 124° C. |

*MI: Melt Flow Index as measured by the method of ASTM D-1238 condition E.

TABLE 2

| | Composite Fibers | | | | Web | | | |
|---|---|---|---|---|---|---|---|---|
| | | | | | Heat Shrinkage (%) | | | |
| | Polyolefinic Material | Composite*4 Type | Number*1 of Crimps (Crimps/25 mm) | Other Fiber Content (Weight %) | "A" (at 100° C.) | "B" (at 120° C.) | "B"-"A" | at 150° C. |
| Example 1 | P-1/P-4 | S/S | 57 | | 33 | 68 | 35 | 82 |
| Example 2 | P-2/P-5 | S/S | 43 | | 24 | 61 | 37 | 71 |
| Example 3 | P-2/P-4 | S/S | 52 | | 29 | 61 | 32 | 73 |
| Example 4 | P-5/P-2 | S/C | 38 | | 19 | 53 | 34 | 70 |
| Example 5 | P-1/P-4 | S/S | 57 | *2 10 | 28 | 63 | 35 | 76 |
| Example 6 | P-1/P-4 | S/S | 57 | *2 30 | 20 | 51 | 31 | 66 |
| Comparative Example 1 | P-3/P-6 | S/S | 24 | | 9 | 10 | 1 | 23 |
| Comparative Example 2 | P-4/P-3 | S/C | 27 | | 12 | 15 | 3 | 34 |
| Comparative Example 3 | P-1/P-7 | S/S | 48 | | 70 | 74 | 4 | 75 |
| Comparative Example 4*3 | P-5/P-2<br>P-1/P-7 | S/S<br>S/S | 38<br>48 | *5 10 | 47 | 54 | 7 | 63 |

| | Nonwoven Fabrics | | | | |
|---|---|---|---|---|---|
| | | | Elastic Recovery (%) | | Uni- |
| | Hot Air Temp (°C.) | Weight Per Area (g/m²) | Warp | Weft | Formity |
| Example 1 | 130 | 80 | 100 | 99 | Fairy Good |
| | 150 | 120 | 100 | 99 | Fairy Good |
| Example 2 | 130 | 61 | 98 | 100 | Fairy Good |
| | 150 | 75 | 100 | 100 | Fairy Good |
| Example 3 | 130 | 54 | 100 | 98 | Fairy Good |
| | 150 | 78 | 100 | 99 | Fairy Good |
| Example 4 | 130 | 48 | 94 | 90 | Fairy Good |
| | 150 | 70 | 98 | 96 | Fairy Good |
| Example 5 | 130 | 65 | 98 | 97 | Fairy Good |
| | 150 | 90 | 99 | 98 | Fairy Good |
| Example 6 | 130 | 52 | 96 | 92 | Fairy Good |
| | 150 | 65 | 98 | 94 | Good |
| Comparative Example 1 | 130 | 25 | 30 | 28 | Good |
| | 150 | 28 | 36 | 28 | Good |
| Comparative Example 2 | 130 | 25 | 26 | 22 | Good |
| | 150 | 32 | 30 | 26 | Good |
| Comparative Example 3 | 130 | 86 | 50 | 56 | Bad |
| | 150 | 86 | 47 | 52 | Bad |
| Comparative Example 4*3 | 130 | 50 | 36 | 46 | Bad |
| | 150 | 54 | 41 | 50 | Bad |

*1Number of Crimps after 5-minute heat treatment at 145° C.
*2Polyester regular fibers
*3Use of two composite fibers at equal amounts.
*4S/S = side-by-side, S/C = sheath-core
*5Rayon Table 2 reveals the following.

When heat-treated at 130° C. after hydraulic entangling, the webs consisting only of the heat-bondable composite fibers and meeting such heat shrinking percentage "A" at 100° C. and "B" at 120° C. as defined in the present invention give nonwoven fabrics having an elastic recovery of 90% or higher in both the warp and weft directions as well as excelling in uniformity, as achieved in Examples 1 to 4. Similar results were obtained even in Examples 5 and 6 wherein the webs comprised a combination of the heat-bondable composite fibers with other fibers. With the webs failing to meet such heat shrinking percentage "A" and "B" as defined in the present invention, however, any desired nonwoven fabric is not obtained. That is, too low web heat shrinking percentage "B" give nonwoven fabrics poor in elastic recovery, as shown in Comparative Examples 1 and 2. In Comparative Example 3 wherein the web heat shrinking percentage "A" was too high and in Comparative Example 4 wherein the difference "B"-"A" departed from the defined scope, the obtained nonwoven fabrics are poor in both uniformity and elastic recovery.

Even with heat treatments at 150° C., the nonwoven fabrics obtained in Examples 1 to 6 excel in both uniformity and elastic recovery. In the case of Comparative Examples 1 to 4, however, the obtained nonwoven fabrics are poor in both uniformity and elastic recovery, although this is not true of the uniformity of the products obtained in Comparative Examples 1 and 2.

Additionally, it is found that, at whatever temperature the heat-treatment temperature took place, the nonwoven fabrics of Examples 1 to 6 were free from such surface tackiness as experienced on polyurethane nonwoven fabrics, and were flexible and excellent in handling. In terms of surface tackiness, a parallel was also found for the nonwoven fabrics of Comparative Examples 1 to 4, but they were all inferior in flexibility and hard in handling, even though they were obtained by heat-treating at either 130° C. or 150° C.

What is claimed is:

1. A stretchable nonwoven fabric formed from a hydro-entangled uniform web comprising 70 to 100% by weight of polypropylene base heat-bondable composite fibers and 0 to 30% by weight of other organic fibers and having a heat shrinking percentage "A" of 50% or lower at 100° C. and a heat shrinking percentage "B" of 50% or higher at 120° C. provided that the difference "B"-"A" between the later and the former is 20% or higher, said fibers being crimped and uniformly entangled as a result of crimping and increased entanglement of the above composite fibers resulting from said web having had hot air at a temperature greater than 120° C. and less than the melting point of the high melting component of said composite fibers blown on the front and back sides thereof alternately and successively, said stretchable nonwoven fabric having an elastic recovery-at-30%-elongation of 80% or higher in both the warp and waft directions.

2. A stretchable nonwoven fabric as claimed in claim 1, in which said composite fibers are heat-bonded together at their portions of contact with one another.

3. A method for producing stretchable nonwoven fabric, which comprises:

subjecting to a water needle technique a uniform web comprising 70 to 100% by weight of polypropylene base heat-bondable and heat-crimpable composite fibers and 0 to 30% by weight of other organic fibers and having a web heat shrinking percentage "A" of 50% or lower at 100° C. and a web heat shrinking percentage "B" of 50% or higher at 120° C. with the proviso that a difference "B"-"A" between the latter and the former is 20% or higher, to uniformly entangle together said fibers, and delivering the thus obtained web, in which the fibers have been hydro-entangled, with no tension applied thereon, while hot air is blown on the front and back sides thereof alternately and successively, the temperature of said hot air being between 120° C. and lower than the melting point of the high-melting component of said heat-bondable composite fibers, thereby further heat-treating said composite fibers to impart sufficient crimping and more increased entanglement thereto for the purpose of shrinking said web.

4. A method for producing stretchable nonwoven fabric as claimed in claim 3, wherein said composite fibers are heat-bonded together at their portions of contact with one another by using hot air of a temperature higher than the melting point of a low-melting component of said heat-bondable composite fibers.

* * * * *